US005638886A

United States Patent [19]

Aghajanian et al.

[11] Patent Number: 5,638,886

[45] Date of Patent: *Jun. 17, 1997

[54] METHOD FOR FORMING METAL MATRIX COMPOSITES HAVING VARIABLE FILLER LOADINGS

[75] Inventors: Michael Kevork Aghajanian, Bel Air, Md.; Alan Scott Nagelberg, Wilmington; Christopher Robin Kennedy, Newark, both of Del.

[73] Assignee: Lanxide Technology Company, LP, Newark, Del.

[*] Notice: The portion of the term of this patent subsequent to Jun. 4, 2008, has been disclaimed.

[21] Appl. No.: 561,565

[22] Filed: Nov. 22, 1995

Related U.S. Application Data

[63] Continuation of Ser. No. 198,730, Feb. 18, 1994, abandoned, which is a continuation of Ser. No. 883,807, May 14, 1992, Pat. No. 5,287,911, which is a continuation of Ser. No. 521,203, May 9, 1990, abandoned, which is a continuation-in-part of Ser. No. 269,312, Nov. 10, 1988, Pat. No. 5,020, 584.

[51] Int. Cl.[6] ..... B22D 19/14

[52] U.S. Cl. ..... 164/97; 164/98

[58] Field of Search ..... 164/97, 98

[56] References Cited

U.S. PATENT DOCUMENTS

| | | | |
|---|---|---|---|
| 918,069 | 4/1909 | Marius et al. | 164/97 |
| 3,031,340 | 4/1962 | Girardot | 117/118 |
| 3,149,409 | 9/1964 | Maruhn | 29/156.5 |
| 3,364,976 | 1/1968 | Reding et al. | 164/63 |
| 3,396,777 | 8/1968 | Reding, Jr. | 164/97 |

(List continued on next page.)

FOREIGN PATENT DOCUMENTS

| | | |
|---|---|---|
| 0071449 | 2/1983 | European Pat. Off. . |
| 0094353 | 11/1983 | European Pat. Off. . |
| 0115742 | 8/1984 | European Pat. Off. . |
| 0280830 | 9/1988 | European Pat. Off. . |
| 0291441 | 11/1988 | European Pat. Off. . |
| 0340957 | 11/1989 | European Pat. Off. . |
| 0364963 | 4/1990 | European Pat. Off. . |
| 2819076 | 10/1979 | Germany . |
| 0144441 | 8/1983 | Japan . |
| 63-192549 | 8/1988 | Japan . |
| 1271051 | 10/1989 | Japan . |
| 2081353 | 2/1982 | United Kingdom . |
| 2156718 | 10/1985 | United Kingdom . |
| 2219537 | 12/1989 | United Kingdom . |
| 8603997 | 7/1986 | WIPO . |

OTHER PUBLICATIONS

F. Delannay, L. Froyen, and A. Deruyttere, "Review: The Wetting of Solids by Molten Metals and Its Relation to the Preparation of Metal–Matrix Composites", Journal of Materials Science, vol. 22, No. 1, pp. 1–16, Jan. 1987.

G. R. Edwards and D. L. Olson, "The Infiltration Kinetics of Aluminum in Silicon Carbide Compacts", Annual Report from Center for Welding Research, Colorado School of Mines, under ONR Contract No. M00014–85–K–0451, DTIC Report AD–A184 682, Jul. 1987.

(List continued on next page.)

*Primary Examiner*—Joseph J. Hail, III
*Assistant Examiner*—I. H. Lin
*Attorney, Agent, or Firm*—Kevin J. Boland

[57] ABSTRACT

The present invention relates to a novel method for forming metal matrix composite bodies and novel products produced by the method. Particularly, a permeable mass of filler material or a preform is provided which has included therein at least some matrix metal powder. Moreover, an infiltration enhancer and/or an infiltration enhancer precursor and/or an infiltrating atmosphere are in communication with the filler material or preform, at least at some point during the process, which permits molten matrix metal, upon contact with the filler material or preform, to spontaneously infiltrate the filler material or preform. The presence of powdered matrix metal in the preform or filler material reduces the relative volume fraction of filler material to matrix metal.

19 Claims, 2 Drawing Sheets

U.S. PATENT DOCUMENTS

| | | | |
|---|---|---|---|
| 3,547,180 | 12/1970 | Cochran et al. | 164/61 |
| 3,608,170 | 9/1971 | Larson et al. | 29/149.5 |
| 3,718,441 | 2/1973 | Landingham | 29/182.1 |
| 3,864,154 | 2/1975 | Gazza et al. | 29/123 B |
| 3,868,267 | 2/1975 | Gazza et al. | 117/22 |
| 3,915,699 | 10/1975 | Umehara et al. | 75/208 R |
| 3,969,553 | 7/1976 | Kondo et al. | 427/99 |
| 3,970,136 | 7/1976 | Cannell et al. | 164/108 |
| 4,034,464 | 7/1977 | Hetke | 164/97 |
| 4,082,864 | 4/1978 | Kendall et al. | 427/248 |
| 4,232,091 | 11/1980 | Grimshaw et al. | 428/472 |
| 4,376,803 | 3/1983 | Katzman | 428/408 |
| 4,376,804 | 3/1983 | Katzman | 428/408 |
| 4,450,207 | 5/1984 | Donomoto et al. | 428/614 |
| 4,473,103 | 9/1984 | Kenney et al. | 164/97 |
| 4,559,246 | 12/1985 | Jones | 427/299 |
| 4,570,316 | 2/1986 | Sakamaki et al. | 29/156.8 R |
| 4,630,665 | 12/1986 | Novak et al. | 164/97 |
| 4,657,065 | 4/1987 | Wada et al. | 164/461 |
| 4,662,429 | 5/1987 | Wada et al. | 164/461 |
| 4,673,435 | 6/1987 | Yamaguchi et al. | 75/235 |
| 4,713,111 | 12/1987 | Cameron et al. | 75/68 R |
| 4,753,690 | 6/1988 | Wada et al. | 148/11.5 A |
| 4,777,097 | 10/1988 | Kubo et al. | 428/614 |
| 4,802,524 | 2/1989 | Donomoto | 164/97 |
| 4,828,008 | 5/1989 | White et al. | 164/66.1 |
| 4,871,008 | 10/1989 | Dwivedi et al. | 164/6 |
| 4,889,774 | 12/1989 | Fukizawa et al. | 164/97 |
| 4,932,099 | 6/1990 | Corwin | 164/97 |
| 4,935,055 | 6/1990 | Aghajanian et al. | 164/97 |
| 4,995,444 | 2/1991 | Jolly et al. | 164/97 |
| 5,020,584 | 6/1991 | Aghajanian et al. | 164/97 |
| 5,287,911 | 2/1994 | Aghajanian et al. | 164/98 |

OTHER PUBLICATIONS

A. Mortensen, M. N. Gungor, J. A. Cornie, and M. C. Flemings "Alloy Microstructures in Cast Metal Matrix Composites", Journal of Metals, vol. 38, No. 3, pp. 30–35, Mar. 1986.

A. Mortensen, J. A. Cornie, and M. C. Flemings, "Solidification Processing of Metal–Matrix Composites", Journal of Metals, vol. 40, No. 2, pp. 12–19, Feb. 11988.

B. D. Sparks and F. W. Meadus, "The Development of an Infiltrated Lead/Iron Composite Material For Use as a Non–toxic Bird Shot", Composites, pp. 37–39, Jan. 1978.

METHOD FOR FORMING METAL MATRIX COMPOSITES HAVING VARIABLE FILLER LOADINGS

CROSS-REFERENCE TO RELATED APPLICATION

This is a continuation of application Ser. No. 08/198,730 filed on Feb. 18, 1994 and now abandoned, which is a continuation of U.S. Ser. No. 07/883,807, filed on May 14, 1992, and which issued on Feb. 22, 1994 as U.S. Pat. No. 5,287,911, which is a continuation of U.S. Ser. No. 07/521,203, filed on May 9, 1990 and now abandoned, which is a continuation-in-part of U.S. Ser. No. 07/269,312, filed on Nov. 10, 1988, and which issued on Jun. 4, 1991 as U.S. Pat. No. 5,020,584.

FIELD OF THE INVENTION

The present invention relates to a novel method for forming metal matrix composite bodies and novel products produced by the method. Particularly, a permeable mass of filler material or a preform is provided which has included therein at least some matrix metal powder. Moreover, an infiltration enhancer and/or an infiltration enhancer precursor and/or an infiltrating atmosphere are in communication with the filler material or preform, at least at some point during the process, which permits molten matrix metal, upon contact with the filler material or preform, to spontaneously infiltrate the filler material or preform. The presence of powdered matrix metal in the preform or filler material reduces the relative volume fraction of filler material to matrix metal.

BACKGROUND OF THE INVENTION

Composite products comprising a metal matrix and a strengthening or reinforcing phase such as ceramic particulates, whiskers, fibers or the like, show great promise for a variety of applications because they combine some of the stiffness and wear resistance of the reinforcing phase with the ductility and toughness of the metal matrix. Generally, a metal matrix composite will show an improvement in such properties as strength, stiffness, contact wear resistance, and elevated temperature strength retention relative to the matrix metal in monolithic form, but the degree to which any given property may be improved depends largely on the specific constituents, their volume or weight fraction, and how they are processed in forming the composite. In some instances, the composite also may be lighter in weight than the matrix metal per se. Aluminum matrix composites reinforced with ceramics such as silicon carbide in particulate, platelet, or whisker form, for example, are of interest because of their higher stiffness, wear resistance and high temperature strength relative to aluminum.

Various metallurgical processes have been described for the fabrication of aluminum matrix composites, including methods based on powder metallurgy techniques and liquid-metal infiltration techniques which make use of pressure casting, vacuum casting, stirring, and wetting agents. With powder metallurgy techniques, the metal in the form of a powder and the reinforcing material in the form of a powder, whiskers, chopped fibers, etc., are admixed and then either cold-pressed and sintered, or hot-pressed. The maximum ceramic volume fraction in silicon carbide reinforced aluminum matrix composites produced by this method has been reported to be about 25 volume percent in the case of whiskers, and about 40 volume percent in the case of particulates.

The production of metal matrix composites by powder metallurgy techniques utilizing conventional processes imposes certain limitations with respect to the characteristics of the products attainable. The volume fraction of the ceramic phase in the composite is limited typically, in the case of particulates, to about 40 percent. Also, the pressing operation poses a limit on the practical size attainable. Only relatively simple product shapes are possible without subsequent processing (e.g., forming or machining) or without resorting to complex presses. Also, nonuniform shrinkage during sintering can occur, as well as nonuniformity of microstructure due to segregation in the compacts and grain growth.

U.S. Pat. No. 3,970,136, granted Jul. 20, 1976, to J. C. Cannell et al., describes a process for forming a metal matrix composite incorporating a fibrous reinforcement, e.g. silicon carbide or alumina whiskers, having a predetermined pattern of fiber orientation. The composite is made by placing parallel mats or felts of coplanar fibers in a mold with a reservoir of molten matrix metal, e.g., aluminum, between at least some of the mats and applying pressure to force molten metal to penetrate the mats and surround the oriented fibers. Molten metal may be poured onto the stack of mats while being forced under pressure to flow between the mats. Loadings of up to about 50% by volume of reinforcing fibers in the composite have been reported.

The above-described infiltration process, in view of its dependence on outside pressure to force the molten matrix metal through the stack of fibrous mats, is subject to the vagaries of pressure-induced flow processes, i.e., possible non-uniformity of matrix formation, porosity, etc. Non-uniformity of properties is possible even though molten metal may be introduced at a multiplicity of sites within the fibrous array. Consequently, complicated mat/reservoir arrays and flow pathways need to be provided to achieve adequate and uniform penetration of the stack of fiber mats. Also, the aforesaid pressure-infiltration method allows for only a relatively low reinforcement to matrix volume fraction to be achieved because of the difficulty inherent in infiltrating a large mat volume. Still further, molds are required to contain the molten metal under pressure, which adds to the expense of the process. Finally, the aforesaid process, limited to infiltrating aligned particles or fibers, is not directed to formation of aluminum metal matrix composites reinforced with materials in the form of randomly oriented particles, whiskers or fibers.

In the fabrication of aluminum matrix-alumina filled composites, aluminum does not readily wet alumina, thereby making it difficult to form a coherent product. Various solutions to this problem have been suggested. One such approach is to coat the alumina with a metal (e.g., nickel or tungsten), which is then hot-pressed along with the aluminum. In another technique, the aluminum is alloyed with lithium, and the alumina may be coated with silica. However, these composites exhibit variations in properties, or the coatings can degrade the filler, or the matrix contains lithium which can affect the matrix properties.

U.S. Pat. No. 4,232,091 to R. W. Grimshaw et al., overcomes certain difficulties in the art which are encountered in the production of aluminum matrix-alumina composites. This patent describes applying pressures of 75–375 $kg/cm^2$ to force molten aluminum (or molten aluminum alloy) into a fibrous or whisker mat of alumina which has been preheated to 700° to 1050° C. The maximum volume ratio of alumina to metal in the resulting solid casting was 0.25/1. Because of its dependency on outside force to accomplish infiltration, this process is subject to many of the same deficiencies as that of Cannell et al.

European Patent Application Publication No. 115,742 describes making aluminum-alumina composites, especially useful as electrolytic cell components, by filling the voids of a preformed alumina matrix with molten aluminum. The application emphasizes the non-wettability of alumina by aluminum, and therefore various techniques are employed to wet the alumina throughout the preform. For example, the alumina is coated with a wetting agent of a diboride of titanium, zirconium, hafnium, or niobium, or with a metal, i.e., lithium, magnesium, calcium, titanium, chromium, iron, cobalt, nickel, zirconium, or hafnium. Inert atmospheres, such as argon, are employed to facilitate wetting. This reference also shows applying pressure to cause molten aluminum to penetrate an uncoated matrix. In this aspect, infiltration is accomplished by evacuating the pores and then applying pressure to the molten aluminum in an inert atmosphere, e.g., argon. Alternatively, the preform can be infiltrated by vapor-phase aluminum deposition to wet the surface prior to filling the voids by infiltration with molten aluminum. To assure retention of the aluminum in the pores of the preform, heat treatment, e.g., at 1400° to 1800° C., in either a vacuum or in argon is required. Otherwise, either exposure of the pressure infiltrated material to gas or removal of the infiltration pressure will cause loss of aluminum from the body.

The use of wetting agents to effect infiltration of an alumina component in an electrolytic cell with molten metal is also shown in European Patent Application Publication No. 94353. This publication describes production of aluminum by electrowinning with a cell having a cathodic current feeder as a cell liner or substrate. In order to protect this substrate from molten cryolite, a thin coating of a mixture of a wetting agent and solubility suppressor is applied to the alumina substrate prior to start-up of the cell or while immersed in the molten aluminum produced by the electrolytic process. Wetting agents disclosed are titanium, zirconium, hafnium, silicon, magnesium, vanadium, chromium, niobium, or calcium, and titanium is stated as the preferred agent. Compounds of boron, carbon and nitrogen are described as being useful in suppressing the solubility of the wetting agents in molten aluminum. The reference, however, does not suggest the production of metal matrix composites, nor does it suggest the formation of such a composite in, for example, a nitrogen atmosphere.

In addition to application of pressure and wetting agents, it has been disclosed that an applied vacuum will aid the penetration of molten aluminum into a porous ceramic compact. For example, U.S. Pat. No. 3,718,441, granted Feb. 27, 1973, to R. L. Landingham, reports infiltration of a ceramic compact (e.g., boron carbide, alumina and beryllia) with either molten aluminum, beryllium, magnesium, titanium, vanadium, nickel or chromium under a vacuum of less than $10^{-6}$ torr. A vacuum of $10^{-2}$ to $10^{-6}$ torr resulted in poor wetting of the ceramic by the molten metal to the extent that the metal did not flow freely into the ceramic void spaces. However, wetting was said to have improved when the vacuum was reduced to less than $10^{-6}$ torr.

U.S. Pat. No. 3,864,154, granted Feb. 4, 1975, to G. E. Gazza et al., also shows the use of vacuum to achieve infiltration. This patent describes loading a cold-pressed compact of $AlB_{12}$ powder onto a bed of cold-pressed aluminum powder. Additional aluminum was then positioned on top of the $AlB_{12}$ powder compact. The crucible, loaded with the $AlB_{12}$ compact "sandwiched" between the layers of aluminum powder, was placed in a vacuum furnace. The furnace was evacuated to approximately $10^{-5}$ torr to permit outgassing. The temperature was subsequently raised to 1100° C. and maintained for a period of 3 hours. At these conditions, the molten aluminum penetrated the porous $AlB_{12}$ compact.

U.S. Pat. No. 3,364,976, granted Jan. 23, 1968 to John N. Reding et al., discloses the concept of creating a self-generated vacuum in a body to enhance penetration of a molten metal into the body. Specifically, it is disclosed that a body, e.g., a graphite mold, a steel mold, or a porous refractory material, is entirely submerged in a molten metal. In the case of a mold, the mold cavity, which is filled with a gas reactive with the metal, communicates with the externally located molten metal through at least one orifice in the mold. When the mold is immersed into the melt, filling of the cavity occurs as the self-generated vacuum is produced from the reaction between the gas in the cavity and the molten metal. Particularly, the vacuum is a result of the formation of a solid oxidized form of the metal. Thus, Reding et al. disclose that it is essential to induce a reaction between gas in the cavity and the molten metal. However, utilizing a mold to create a vacuum may be undesirable because of the inherent limitations associated with use of a mold. Molds must first be machined into a particular shape; then finished, machined to produce an acceptable casting surface on the mold; then assembled prior to their use; then disassembled after their use to remove the cast piece therefrom; and thereafter reclaim the mold, which most likely would include refinishing surfaces of the mold or discarding the mold if it is no longer acceptable for use. Machining of a mold into a complex shape can be very costly and time-consuming. Moreover, removal of a formed piece from a complex-shaped mold can also be difficult (i.e., cast pieces having a complex shape could be broken when removed from the mold). Still further, while there is a suggestion that a porous refractory material can be immersed directly in a molten metal without the need for a mold, the refractory material would have to be an integral piece because there is no provision for infiltrating a loose or separated porous material absent the use of a container mold (i.e., it is generally believed that the particulate material would typically disassociate or float apart when placed in a molten metal). Still further, if it was desired to infiltrate a particulate material or loosely formed preform, precautions should be taken so that the infiltrating metal does not displace at least portions of the particulate or preform resulting in a non-homogeneous microstructure.

Accordingly, there has been a long felt need for a simple and reliable process to produce shaped metal matrix composites which does not rely upon the use of applied pressure or vacuum (whether externally applied or internally created), or damaging wetting agents to create a metal matrix embedding another material such as a ceramic material. Moreover, there has been a long felt need to minimize the amount of final machining operations needed to produce a metal matrix composite body. The present invention satisfies these needs by providing a spontaneous infiltration mechanism for infiltrating a material (e.g., a ceramic material), which is formed into a preform, with molten matrix metal (e.g., aluminum) in the presence of an infiltrating atmosphere (e.g., nitrogen) under normal atmospheric pressures so long as an infiltration enhancer is present at least at some point during the process.

Description Of Commonly Owned U.S. Patent and Patent Applications

The subject matter of this application is related to that of a co-owned Patent and several other copending and co-owned patent applications. Particularly, the patent and other copending patent applications describe novel methods for making metal matrix composite materials (hereinafter sometimes referred to as "Commonly Owned Metal Matrix Patent and Patent Applications").

A novel method of making a metal matrix composite material is disclosed in Commonly Owned U.S. Pat. No. 4,828,008, which issued May 9, 1989, from U.S. patent application Ser. No. 049,171, filed May 13, 1987, in the names of White et al., and entitled "Metal Matrix Composites" and which published the EPO on Nov. 17, 1988, as Publication No. 0291441. According to the method of this White et al. invention, a metal matrix composite is produced by infiltrating a permeable mass of filler material (e.g., a ceramic or a ceramic-coated material) with molten aluminum containing at least about 1 percent by weight magnesium, and preferably at least about 3 percent by weight magnesium. Infiltration occurs spontaneously without the application of external pressure or vacuum. A supply of the molten metal alloy is contacted with the mass of filler material at a temperature of at least about 675° C. in the presence of a gas comprising from about 10 to 100 percent, and preferably at least about 50 percent, nitrogen by volume, and a remainder of the gas, if any, being a nonoxidizing gas, e.g., argon. Under these conditions, the molten aluminum alloy infiltrates the ceramic mass under normal atmospheric pressures to form an aluminum (or aluminum alloy) matrix composite. When the desired amount of filler material has been infiltrated with the molten aluminum alloy, the temperature is lowered to solidify the alloy, thereby forming a solid metal matrix structure that embeds the reinforcing filler material. Usually, and preferably, the supply of molten alloy delivered will be sufficient to permit the infiltration to proceed essentially to the boundaries of the mass of filler material. The amount of filler material in the aluminum matrix composites produced according to the White et al. invention may be exceedingly high. In this respect, filler to alloy volumetric ratios of greater than 1:1 may be achieved.

Under the process conditions in the aforesaid White et al. invention, aluminum nitride can form as a discontinuous phase dispersed throughout the aluminum matrix. The amount of nitride in the aluminum matrix may vary depending on such factors as temperature, alloy composition, gas composition and filler material. Thus, by controlling one or more such factors in the system, it is possible to tailor certain properties of the composite. For some end use applications, however, it may be desirable that the composite contain little or substantially no aluminum nitride.

It has been observed that higher temperatures favor infiltration but render the process more conducive to nitride formation. The White et al. invention allows the choice of a balance between infiltration kinetics and nitride formation.

An example of suitable barrier means for use with metal matrix composite formation is described in Commonly Owned and Copending U.S. patent application Ser. No. 141,642, filed Jan. 7, 1988, in the names of Michael K. Aghajanian et al., and entitled "Method of Making Metal Matrix Composite with the Use of a Barrier" (now allowed in the United States), and which published in the EPO on Jul. 12, 1989, as Publication No. 0323945. According to the method of this Aghajanian et al. invention, a barrier means (e.g., particulate titanium diboride or a graphite material such as a flexible graphite tape product sold by Union Carbide under the trade name Grafoil®) is disposed on a defined surface boundary of a filler material and matrix alloy infiltrates up to the boundary defined by the barrier means. The barrier means is used to inhibit, prevent, or terminate infiltration of the molten alloy, thereby providing net, or near net, shapes in the resultant metal matrix composite. Accordingly, the formed metal matrix composite bodies have an outer shape which substantially corresponds to the inner shape of the barrier means.

The method of U.S. Pat. No. 4,828,008 was improved upon by Commonly Owned and Copending U.S. patent application Ser. No. 168,284, filed Mar. 15, 1988, in the names of Michael K. Aghajanian and Marc S. Newkirk and entitled "Metal Matrix Composites and Techniques for Making the Same", and which published in the EPO on Sep. 20, 1989, as Publication No. 0333629. In accordance with the methods disclosed in this U.S. Patent Application, a matrix metal alloy is present as a first source of metal and as a reservoir of matrix metal alloy which communicates with the first source of molten metal due to, for example, gravity flow. Particularly, under the conditions described in this patent application, the first source of molten matrix alloy begins to infiltrate the mass of filler material under normal atmospheric pressures and thus begins the formation of a metal matrix composite. The first source of molten matrix metal alloy is consumed during its infiltration into the mass of filler material and, if desired, can be replenished, preferably by a continuous means, from the reservoir of molten matrix metal as the spontaneous infiltration continues. When a desired amount of permeable filler has been spontaneously infiltrated by the molten matrix alloy, the temperature is lowered to solidify the alloy, thereby forming a solid metal matrix structure that embeds the reinforcing filler material. It should be understood that the use of a reservoir of metal is simply one embodiment of the invention described in this patent application and it is not necessary to combine the reservoir embodiment with each of the alternate embodiments of the invention disclosed therein, some of which could also be beneficial to use in combination with the present invention.

The reservoir of metal can be present in an amount such that it provides for a sufficient amount of metal to infiltrate the permeable mass of filler material to a predetermined extent. Alternatively, an optional barrier means can contact the permeable mass of filler on at least one side thereof to define a surface boundary.

Moreover, while the supply of molten matrix alloy delivered should be at least sufficient to permit spontaneous infiltration to proceed essentially to the boundaries (e.g., barriers) of the permeable mass of filler material, the amount of alloy present in the reservoir could exceed such sufficient amount so that not only will there be a sufficient amount of alloy for complete infiltration, but excess molten metal alloy could remain and be attached to the metal matrix composite body (e.g., a macrocomposite). Thus, when excess molten alloy is present, the resulting body will be a complex composite body (e.g., a macrocomposite), wherein an infiltrated ceramic body having a metal matrix therein will be directly bonded to excess metal remaining in the reservoir.

Further improvements in metal matrix technology can be found in commonly owned and copending U.S. patent application Ser. No. 07/416,327, filed Oct. 6, 1989, which is a continuation-in-part application of U.S. patent application Ser. No. 07/349,590, filed May 9, 1989, which in turn is a continuation-in-part application of U.S. patent application Ser. No. 07/269,311, filed Nov. 10, 1988, all of which were filed in the names of Michael K. Aghajanian et al. and all of which are entitled "A Method of Forming Metal Matrix Composite Bodies By A Spontaneous Infiltration Process, and Products Produced Therefrom." According to these Aghajanian et al. applications, spontaneous infiltration of a matrix metal into a permeable mass of filler material or preform is achieved by use of an infiltration enhancer and/or an infiltration enhancer precursor and/or an infiltrating atmosphere which are in communication with the filler material or preform, at least at some point during the process, which permits molten matrix metal to spontaneously infiltrate the filler material or preform. Aghajanian et al. disclose a number of matrix metal/infiltration enhancer precursor/infiltrating atmosphere systems which exhibit spontaneous infiltration. Specifically, Aghajanian et al. disclose that spontaneous infiltration behavior has been observed in the aluminum/magnesium/nitrogen system; the aluminum/strontium/nitrogen system; the aluminum/zinc/oxygen system; and the aluminum/calcium/nitrogen system. However, it is clear from the disclosure set forth in the Aghajanian et al. applications that the spontaneous infiltration behavior should occur in other matrix metal/infiltration enhancer precursor/infiltrating atmosphere systems.

Each of the above-discussed Commonly Owned Metal Matrix Patent and Patent Applications describes methods for the production of metal matrix composite bodies and novel metal matrix composite bodies which are produced therefrom. The entire disclosures of all of the foregoing Commonly Owned Metal Matrix Patent and Patent Applications are expressly incorporated herein by reference.

SUMMARY OF THE INVENTION

A metal matrix composite body having a variable and tailorable volume fraction of filler material is produced by mixing at least some powdered matrix metal with a filler material or preform and thereafter spontaneously infiltrating the filler material or preform with molten matrix metal. Specifically, an infiltration enhancer and/or an infiltration enhancer precursor and/or an infiltrating atmosphere are in communication with the filler material or preform, at least at some point during the process, which permits molten matrix metal to spontaneously infiltrate the filler material or preform.

The powdered matrix metal which is added to the preform or filler material functions to reduce the volume fraction of filler material relative to matrix metal by acting as a spacer material between the filler. Specifically, a filler material or preform can contain only a limited amount of porosity before it becomes difficult, if not impossible, to handle due to its low strength. However, if a powdered matrix metal is mixed with the filler material or preform, an effective porosity can be achieved (i.e., rather than supplying a filler material or preform with higher porosity, powdered matrix metal can be added to the filler or preform). In this regard, so long as the powdered matrix metal forms a desirable alloy or intermetallic with the molten matrix metal which spontaneously infiltrates the filler material or preform, and no deleterious effect upon the spontaneous infiltration is obtained, the resultant metal matrix composite body would have the appearance of having been made with a very porous filler material or preform.

The powdered matrix metal combined in the filler material or preform, can have exactly the same, substantially the same or a somewhat different chemical composition from the matrix metal which spontaneously infiltrates the filler material or preform. However, if the powdered matrix metal is different in composition from the matrix metal which infiltrates the filler material or preform, desirable intermetallics and/or alloys should be formed from the combination of matrix metal and powdered matrix metal to enhance the properties of the metal matrix composite body.

In a preferred embodiment of the invention, a precursor to an infiltration enhancer may be supplied to at least one of the matrix metal and/or the powdered matrix metal and/or the filler material or preform and/or the infiltrating atmosphere. The precursor to the infiltration enhancer may then react with another species in the spontaneous system to form infiltration enhancer.

It is noted that this application discusses primarily aluminum matrix metals which, at some point during the formation of the metal matrix composite body, are contacted with magnesium, which functions as the infiltration enhancer precursor, in the presence of nitrogen, which functions as the infiltrating atmosphere. Thus, the matrix metal/infiltration enhancer precursor/infiltrating atmosphere system of aluminum/magnesium/nitrogen exhibits spontaneous infiltration. However, other matrix metal/infiltration enhancer precursor/infiltrating atmosphere systems may also behave in a manner similar to the system aluminum/magnesium/nitrogen. For example, similar spontaneous infiltration behavior has been observed in the aluminum/strontium/nitrogen system; the aluminum/zinc/oxygen system; and the aluminum/calcium/nitrogen system. Accordingly, even though the aluminum/magnesium/nitrogen system is discussed primarily herein, it should be understood that other matrix metal/infiltration enhancer precursor/infiltrating atmosphere systems may behave in a similar manner.

Moreover, rather than supplying an infiltration enhancer precursor, an infiltration enhancer may be supplied directly to at least one of the filler material or preform, and/or matrix metal, and/or powdered matrix metal filler, and/or infiltrating atmosphere. Ultimately, at least during the spontaneous infiltration, the infiltration enhancer should be located in at least a portion of the filler material or preform.

When the matrix metal comprises an aluminum alloy, the aluminum alloy is contacted with a preform or a filler material (e.g., alumina or silicon carbide), which filler material has admixed therewith, or at some point during the process is exposed to, magnesium. Moreover, in a preferred embodiment the aluminum alloy and/or preform or filler material are contained in a nitrogen atmosphere for at least a portion of the process. The preform will be spontaneously infiltrated by the matrix metal and the extent or rate of spontaneous infiltration and formation of metal matrix will vary with a given set of process conditions including, for example, the concentration of magnesium provided to the system (e.g., in the aluminum alloy and/or in the powdered matrix metal alloy and/or in the filler material or preform and/or in the infiltrating atmosphere), the size and/or composition of the particles in the preform or filler material, the concentration of nitrogen in the infiltrating atmosphere, the time permitted for infiltration, and/or the size and/or composition and/or amount of powdered matrix metal in the preform or filler material, and/or the temperature at which infiltration occurs. Spontaneous infiltration typically occurs to an extent sufficient to embed substantially completely the preform or filler material.

Definitions

"Aluminum", as used herein, means and includes essentially pure metal (e.g., a relatively pure, commercially available unalloyed aluminum) or other grades of metal and metal alloys such as the commercially available metals having impurities and/or alloying constituents such as iron, silicon, copper, magnesium, manganese, chromium, zinc, etc., therein. An aluminum alloy for purposes of this definition is an alloy or intermetallic compound in which aluminum is the major constituent.

"Balance Non-Oxidizing Gas", as used herein, means that any gas present in addition to the primary gas comprising the infiltrating atmosphere, is either an inert gas or a reducing gas which is substantially non-reactive with the matrix metal under the process conditions. Any oxidizing gas which may be present as an impurity in the gas(es) used should be insufficient to oxidize the matrix metal to any substantial extent under the process conditions.

"Barrier" or "Barrier means", as used herein, means any suitable means which interferes, inhibits, prevents or terminates the migration, movement, or the like, of molten matrix metal beyond a surface boundary of a permeable mass of filler material or preform, where such surface boundary is defined by said barrier means. Suitable barrier means may be any such material, compound, element, composition, or the like, which, under the process conditions, maintains some integrity and is not substantially volatile (i.e., the barrier material does not volatilize to such an extent that it is rendered nonfunctional as a barrier).

Further, suitable "barrier means" includes materials which are substantially non-wettable by the migrating molten matrix metal under the process conditions employed. A barrier of this type appears to exhibit substantially little or no affinity for the molten matrix metal, and movement beyond the defined surface boundary of the mass of filler material or preform is prevented or inhibited by the barrier means. The barrier reduces any final machining or grinding that may be required and defines at least a portion of the surface of the resulting metal matrix composite product. The barrier may in certain cases be permeable or porous, or rendered permeable by, for example, drilling holes or puncturing the barrier, to permit gas to contact the molten matrix metal.

"Carcass" or "Carcass of Matrix Metal", as used herein, refers to any of the original body of matrix metal remaining which has not been consumed during formation of the metal matrix composite body, and typically, if allowed to cool, remains in at least partial contact with the metal matrix composite body which has been formed. It should be understood that the carcass may also include a second or foreign metal therein.

"Filler", as used herein, is intended to include either single constituents or mixtures of constituents which are substantially non-reactive with and/or of limited solubility in the matrix metal and may be single or multi-phase. Fillers may be provided in a wide variety of forms, such as powders, flakes, platelets, microspheres, whiskers, bubbles, etc., and may be either dense or porous. "Filler" may also include ceramic fillers, such as alumina or silicon carbide as fibers, chopped fibers, particulates, whiskers, bubbles, spheres, fiber mats, or the like, and ceramic-coated fillers such as carbon fibers coated with alumina or silicon carbide to protect the carbon from attack, for example, by a molten aluminum parent metal. Fillers may also include metals.

"Infiltrating Atmosphere", as used herein, means that atmosphere which is present which interacts with the matrix metal and/or preform (or filler material) and/or infiltration enhancer precursor and/or infiltration enhancer and permits or enhances spontaneous infiltration of the matrix metal to occur.

"Infiltration Enhancer", as used herein, means a material which promotes or assists in the spontaneous infiltration of a matrix metal into a filler material or preform. An infiltration enhancer may be formed from, for example, a reaction of an infiltration enhancer precursor with an infiltrating atmosphere to form (1) a gaseous species and/or (2) a reaction product of the infiltration enhancer precursor and the infiltrating atmosphere and/or (3) a reaction product of the infiltration enhancer precursor and the filler material or preform. Moreover, the infiltration enhancer may be supplied directly to at least one of the preform, and/or matrix metal, and/or infiltrating atmosphere and function in a substantially similar manner to an infiltration enhancer which has formed as a reaction between an infiltration enhancer precursor and another species. Ultimately, at least during the spontaneous infiltration, the infiltration enhancer should be located in at least a portion of the filler material or preform to achieve spontaneous infiltration.

"Infiltration Enhancer Precursor" or "Precursor to the infiltration Enhancer", as used herein, means a material which when used in combination with the matrix metal, preform and/or infiltrating atmosphere forms an infiltration enhancer which induces or assists the matrix metal to spontaneously infiltrate the filler material or preform. Without wishing to be bound by any particular theory or explanation, it appears as though it may be necessary for the precursor to the infiltration enhancer to be capable of being positioned, located or transportable to a location which permits the infiltration enhancer precursor to interact with the infiltrating atmosphere and/or the preform or filler material and/or metal. For example, in some matrix metal/infiltration enhancer precursor/infiltrating atmosphere systems, it is desirable for the infiltration enhancer precursor to volatilize at, near, or in some cases, even somewhat above the temperature at which the matrix metal becomes molten. Such volatilization may lead to: (1) a reaction of the infiltration enhancer precursor with the infiltrating atmosphere to form a gaseous species which enhances wetting of the filler material or preform by the matrix metal; and/or (2) a reaction of the infiltration enhancer precursor with the infiltrating atmosphere to form a solid, liquid or gaseous infiltration enhancer in at least a portion of the filler material or preform which enhances wetting; and/or (3) a reaction of the infiltration enhancer precursor within the filler material or preform which forms a solid, liquid or gaseous infiltration enhancer in at least a portion of the filler material or preform which enhances wetting.

"Low particle Loading" or "Lower Volume Fraction of Filler Material", as used herein, means that the amount of matrix metal or matrix metal alloy or intermetallic relative to filler material has been increased relative to a filler material or preform which has been spontaneously infiltrated without having powdered matrix metal filler added to the filler material or preform.

"Matrix Metal" or "Matrix Metal Alloy", as used herein, means that metal which is intermingled with a filler material to form a metal matrix composite body. When a specified metal is mentioned as the matrix metal, it should be understood that such matrix metal includes that metal as an essentially pure metal, a commercially available metal having impurities and/or alloying constituents therein, an intermetallic compound or an alloy in which that metal is the major or predominant constituent.

"Matrix Metal/Infiltration Enhancer Precursor/Infiltrating Atmosphere System" or "Spontaneous System", as used herein, refers to that combination of materials which exhibit spontaneous infiltration into a preform or filler material. It should be understood that whenever a "/" appears between an exemplary matrix metal, infiltration enhancer precursor and infiltrating atmosphere that the "/" is used to designate a system or combination of materials which, when combined in a particular manner, exhibits spontaneous infiltration into a preform or filler material.

"Metal Matrix Composite" or "MMC", as used herein, means a material comprising a two- or three-dimensionally interconnected alloy or matrix metal which has embedded a preform or filler material. The matrix metal may include various alloying elements to provide specifically desired mechanical and physical properties in the resulting composite.

A Metal "Different" from the Matrix Metal means a metal which does not contain, as a primary constituent, the same metal as the matrix metal (e.g., if the primary constituent of the matrix metal is aluminum, the "different" metal could have a primary constituent of, for example, nickel).

"Nonreactive Vessel for Housing Matrix Metal" means any vessel which can house or contain a filler material (or preform) and/or molten matrix metal under the process conditions and not react with the matrix and/or the infiltrating atmosphere and/or infiltration enhancer precursor in a manner which would be significantly detrimental to the spontaneous infiltration mechanism.

"Powdered Matrix Metal", as used herein, means a matrix metal which has been formed into a powder and is included in at least a portion of a filler material or preform. It should be understood that the powdered matrix metal could have a composition which is the same as, similar to or quite different from the matrix metal which is to infiltrate the filler material or preform. However, the powdered matrix metal which is to be used should be capable of forming a desirable alloy and/or intermetallic with the matrix metal which is to infiltrate the filler material or preform. Furthermore, the powdered matrix metal filler could include an infiltration enhancer and/or infiltration enhancer precursor.

"Preform" or "Permeable Preform", as used herein, means a porous mass of filler or filler material which is manufactured with at least one surface boundary which essentially defines a boundary for infiltrating matrix metal, such mass retaining sufficient shape integrity and green strength to provide dimensional fidelity prior to being infiltrated by the matrix metal. The mass should be sufficiently porous to accommodate spontaneous infiltration of the matrix metal thereinto. A preform typically comprises a bonded array or arrangement of filler, either homogeneous or heterogeneous, and may be comprised of any suitable material (e.g., ceramic and/or metal particulates, powders, fibers, whiskers, etc., and any combination thereof). A preform may exist either singularly or as an assemblage.

"Reservoir", as used herein means, a separate body of matrix metal positioned relative to a mass of filler or a preform so that, when the metal is molten, it may flow to replenish, or in some cases to initially provide and subsequently replenish, that portion, segment or source of matrix metal which is in contact with the filler or preform.

"Spontaneous Infiltration", as used herein, means the infiltration of matrix metal into the permeable mass of filler or preform occurs without requirement for the application of pressure or vacuum (whether externally applied or internally created).

BRIEF DESCRIPTION OF THE FIGURES

The following figures are provided to assist in understanding the invention, but are not intended to limit the scope of the invention. Similar reference numerals have been used wherever possible in each of the Figures to denote like components, wherein.

DETAILED DESCRIPTION OF THE INVENTION AND PREFERRED EMBODIMENTS

Figure 1:
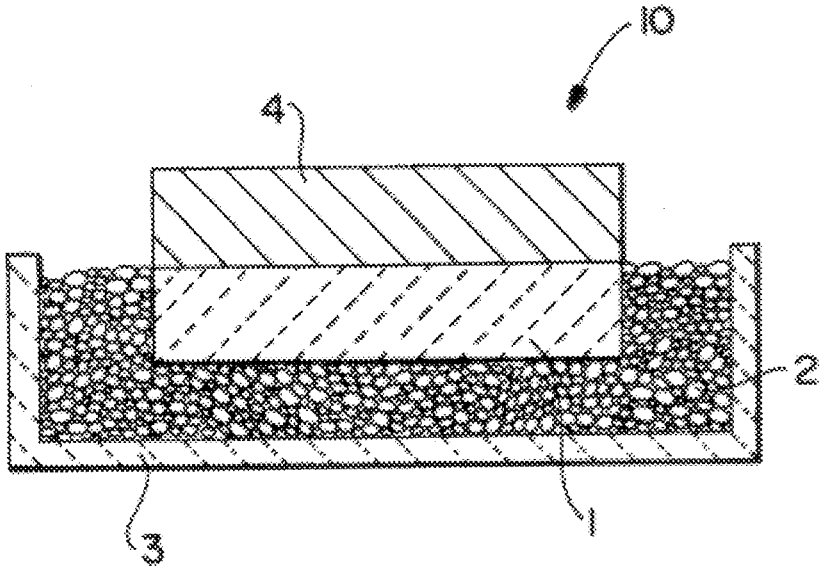
FIG. 1 is a schematic cross-sectional view of a lay-up for producing metal matrix composite having a reduced particle loading in accordance with Examples 1–4.
Figure 2:
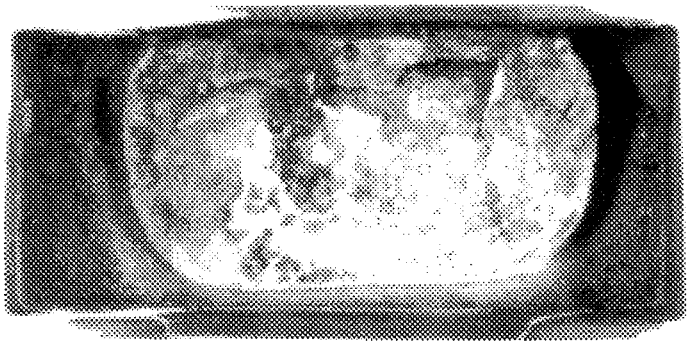
FIGS. 2–5 are photographs of the samples made in accordance with Examples 1–4, respectively.
Figure 3:
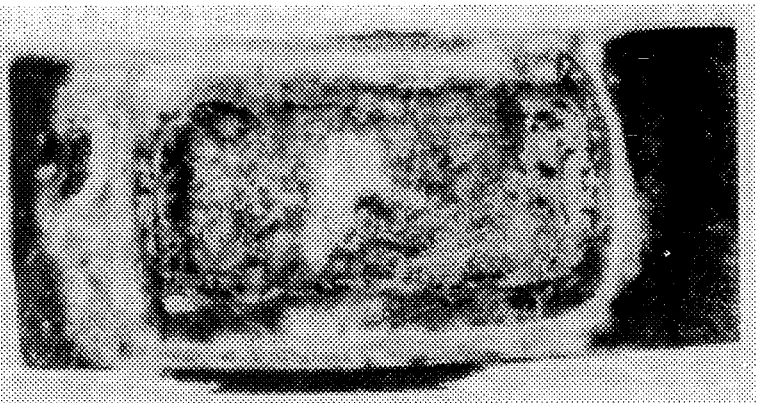
Figure 4:
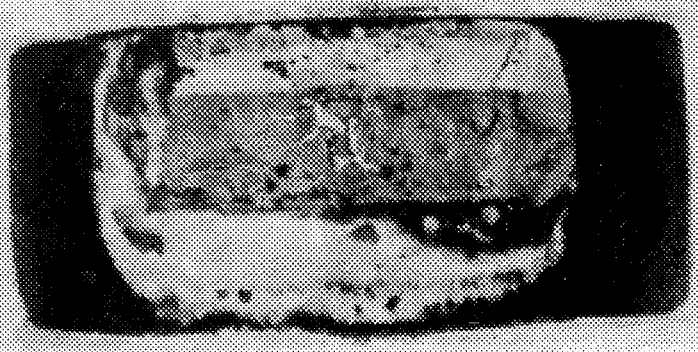
Figure 5:
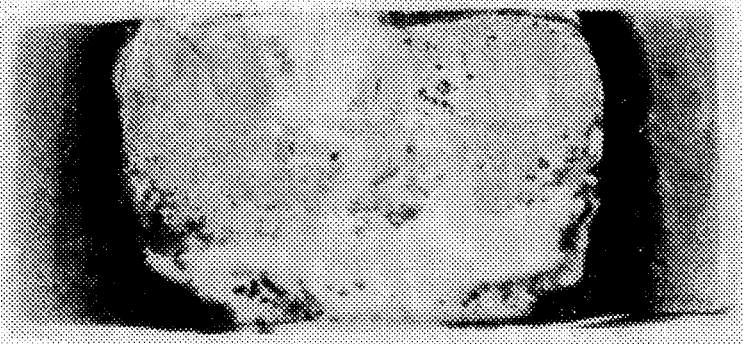

The present invention relates to forming a metal matrix composite body having the capability of including a tailorable and variable volume fraction of filler material. Stated more particularly, by admixing with a filler material or preform some powdered matrix metal, the volume fraction of filler material to matrix metal can be lowered, thus resulting in the capability of adjusting the particle loading and other properties of a formed metal matrix composite body.

Although high particle loads (for example, of the order of 40 to 60 volume percent) are obtainable from spontaneous infiltration methods as disclosed, for example, in commonly owned U.S. Pat. No. 4,828,008, lower particle loadings (of the order 1 to 40 volume percent) are more difficult, if not impossible, to obtain by such methods. Specifically, lower particle loadings using these disclosed techniques require that preforms or filler material be provided with high porosity. However, the porosity which is ultimately obtainable is limited by the filler material or preforms, such porosity being a function of the particular filler material employed and the size or granularity of the particles selected.

In accordance with the present invention, a powdered matrix metal is homogeneously mixed with a filler material to enhance the distance of dispersion of the particles of the filler material, thereby providing a body to be infiltrated of lower porosity. Preforms or filler material comprising from 1 volume percent to 75 volume percent or higher, and preferably 25 volume percent to 75 volume percent, powdered matrix metal can thus be provided for infiltration, depending upon the ultimate volume percent particle loading desired for the resultant product. As will become more apparent from the discussion below and the examples that follow, an increase in the volume percent of powdered matrix metal results in a related decrease in the volume percent ceramic particle loading obtained in the final product. The ceramic particle loading of the final product can thus be tailored by tailoring the powdered matrix metal component of the preform or filler material.

The powdered matrix metal may, but need not be, the same as the matrix metal which spontaneously infiltrates the preform or filler. Use of the same metal for both the powdered matrix metal and matrix metal results, after spontaneous infiltration, in a substantially two phase composite of a filler (e.g., a ceramic filler) or preform and an interdispersed three-dimensionally connected matrix of the matrix metal (with possible secondary nitride phases as discussed below, depending upon process conditions). Alternatively, a powdered matrix metal different from the matrix metal can be selected such that an alloy or intermetallic having desired mechanical, electrical, chemical or other properties forms upon infiltration. Thus, the powdered matrix metal combined in the filler material or preform, can have exactly the same, substantially the same or a somewhat different chemical composition from the spontaneously infiltrated matrix metal.

Moreover, it has been found that the preform or filler material and the powdered matrix metal admixed therein maintain the same or substantially the same relationship, even upon heating beyond the melting point of the powdered matrix metal. Thus, for example, although aluminum oxide is heavier than aluminum, upon heating of an aluminum oxide filler or preform mixed with aluminum, the aluminum oxide does not settle upon heating and a substantially uniform distribution is maintained. Without intending to be limited to any particular theory, it is theorized that the uniform distribution results because the aluminum has an outer oxide skin (or other skin, such as a nitrogen skin, after it is contacted by an infiltrating atmosphere), which prevents particle settlement.

Because substantially uniform distribution is maintained, uniform products are obtained upon infiltration. Moreover, because particle distributions substantially remain intact during heating, the particular powdered matrix metal can be changed or varied in a particular product to create different matrix metals and/or alloys and/or intermetallics having differing properties at different locations in the composite body.

Furthermore, different filler particle to powdered matrix metal loadings may be employed along different parts of a particular body, e.g., to optimize wear, corrosion or erosion resistance, at particularly vulnerable locations of the product and/or to otherwise alter the properties of the body at different locations to suit a particular application.

As is apparent from the foregoing, the powdered matrix metal thus acts as a spacer, to overcome the strength and other physical limitations encountered in trying to fabricate highly porous filler material or preforms. The resultant metal matrix composite body obtained after infiltration has the appearance of having been made from a very porous filler material or preform, without the attendant obstacles or disadvantages.

The filler material or preform and powdered matrix metal mixture can be formed and maintained in a desired shape by one of many conventional means. By way of example only, the filler material or preform and powdered matrix metal mixture can be bound together by a volatilizable binder such as wax, glue, water, slip cast, dispersion cast, dry-pressed, or placed in an inert bedding or formed within a barrier structure (as described in greater detail below). Moreover, any mold suitable for spontaneous infiltration can be utilized to confine and shape the matrix metal and powdered matrix metal mixture to achieve net or near net shape after infiltration. The preform or filler material and powdered matrix metal mixture should, however, remain sufficiently porous to allow the matrix metal and/or infiltrating atmosphere and/or infiltration enhancer and/or infiltration enhancer precursor to infiltrate once spontaneous infiltration is initiated.

Furthermore, the powdered matrix metal need not be in powder form, but could instead be in the form of platelets, fibers, granules, whiskers or the like, depending upon the desired final matrix structure. Maximum uniformity in the distribution of the final product will be achieved, however, if powdered matrix metal is used.

Additionally, in lieu of or in addition to the addition of powdered matrix metal to the filler or preform, the filler material itself may be coated with matrix metal to increase spacing between the particles while still providing a filler material or preform of low enough porosity and of sufficient strength to render it workable.

In order to effect spontaneous infiltration of the matrix metal into the preform, an infiltration enhancer should be provided to the spontaneous system. An infiltration enhancer could be formed from an infiltration enhancer precursor which could be provided (1) in the matrix metal; and/or (2) in the preform or filler material; and/or (3) from an external source into the spontaneous system; and/or (4) in the powdered matrix metal; and/or (5) from the infiltrating atmosphere. Moreover, rather than supplying an infiltration enhancer precursor, an infiltration enhancer may be supplied directly to at least one of the preform, and/or matrix metal, and/or infiltrating atmosphere and/or powdered matrix metal. Ultimately, at least during the spontaneous infiltration, the infiltration enhancer should be located in at least a portion of the filler material or preform.

In a preferred embodiment it is possible that the infiltration enhancer precursor can be at least partially reacted with the infiltrating atmosphere such that infiltration enhancer can be formed in at least a portion of the filler material or preform and/or the powdered matrix metal prior to or substantially contiguous with contacting the preform with the matrix metal (e.g., if magnesium was the infiltration enhancer precursor and nitrogen was the infiltrating atmosphere, the infiltration enhancer could be magnesium nitride which would be located in at least a portion of the preform).

An example of a matrix metal/infiltration enhancer precursor/infiltrating atmosphere system is the aluminum/magnesium/nitrogen system. Specifically, an aluminum matrix metal can be contained within a suitable refractory vessel which, under the process conditions, does not react with the aluminum matrix metal and/or filler material and/or powdered matrix metal when the aluminum is made molten. Under the process conditions, the aluminum matrix metal is induced to infiltrate the filler material or preform spontaneously.

Moreover, rather than supplying an infiltration enhancer precursor, an infiltration enhancer may be supplied directly to at least one of the preform, and/or matrix metal, and/or infiltrating atmosphere and/or powdered matrix metal filler. Ultimately, at least during the spontaneous infiltration, the infiltration enhancer should be located in at least a portion of the filler material or preform.

Under the conditions employed in the method of the present invention, in the case of an aluminum/magnesium/nitrogen spontaneous infiltration system, the filler material or preform should be sufficiently permeable to permit the nitrogen-containing gas to penetrate or permeate the filler material or preform at some point during the process and/or contact the molten matrix metal. Moreover, the permeable filler material or preform can accommodate infiltration of the molten matrix metal, thereby causing the nitrogen-permeated preform to be infiltrated spontaneously with molten matrix metal to form a metal matrix composite body and/or cause the nitrogen to react with an infiltration enhancer precursor to form infiltration enhancer in the filler material or preform and thereby result in spontaneous infiltration. The extent of spontaneous infiltration and formation of the metal matrix composite will vary with a given set of process conditions, including the magnesium content of the aluminum alloy, magnesium content of the filler material or preform, magnesium content of the powdered matrix metal, amount of magnesium nitride in the preform, the presence of additional alloying elements (e.g., silicon, iron, copper, manganese, chromium, zinc, and the like), average size of the filler material (e.g., particle diameter) or particle in the preform, surface condition and type of filler material, average size of powdered matrix metal, surface condition and type of powdered matrix metal, nitrogen concentration of the infiltrating atmosphere, time permitted for infiltration and temperature at which infiltration occurs. For example, for infiltration of the molten aluminum matrix metal to occur spontaneously, the aluminum can be alloyed with at least about 1 percent by weight, and preferably at least about 3 percent by weight, magnesium (which functions as the infiltration enhancer precursor), based on alloy weight. Auxiliary alloying elements, as discussed above, may also be included in the matrix metal to tailor specific properties thereof. Additionally, the auxiliary alloying elements may affect the minimum amount of magnesium required in the matrix aluminum metal to result in spontaneous infiltration of the filler material or preform. Loss of magnesium from the spontaneous system due to, for example, volatilization should not occur to such an extent that no magnesium was present to form infiltration enhancer. Thus, it is desirable to utilize a sufficient amount of initial alloying elements to assure that spontaneous infiltration will not be adversely affected by volatilization. Still further, the presence of magnesium in two or more of the preform, powdered matrix metal and matrix metal or in the preform alone or in the powdered matrix metal alone may result, in a lesser required amount of magnesium to achieve spontaneous infiltration (discussed in greater detail later herein). The volume percent of nitrogen in the nitrogen atmosphere also affects formation rates of the metal matrix composite body. Specifically, if less than about 10 volume percent of nitrogen is present in the atmosphere, very slow or little spontaneous infiltration will occur. It has been discovered that it is preferable for at least about 50 volume percent of nitrogen to be present in the atmosphere, thereby resulting in, for example, shorter infiltration times due to a much more rapid rate of infiltration. The infiltrating atmosphere (e.g., a nitrogen-containing gas) can be supplied directly to the filler material or preform and/or matrix metal, or it may be produced or result from a decomposition of a material.

The minimum magnesium content required for the molten matrix metal to infiltrate a filler material or preform depends on one or more variables such as the processing temperature, time, the presence of auxiliary alloying elements such as silicon or zinc, the nature of the filler material, the nature of the powdered matrix metal, the location of the magnesium in one or more components of the spontaneous system, the nitrogen content of the atmosphere, and the rate at which the nitrogen atmosphere flows. Lower temperatures or shorter heating times can be used to obtain complete infiltration as the magnesium content of the alloy and/or preform is increased. Also, for a given magnesium content, the addition of certain auxiliary alloying elements such as zinc permits the use of lower temperatures. For example, a magnesium content of the matrix metal at the lower end of the operable range, e.g., from about 1 to 3 weight percent, may be used in conjunction with at least one of the following: an above-minimum processing temperature, a high nitrogen concentration, or one or more auxiliary alloying elements. When no magnesium is added to the preform, alloys containing from about 3 to 5 weight percent magnesium are preferred on the basis of their general utility over a wide variety of process conditions, with at least about 5 percent being preferred when lower temperatures and shorter times are employed. Magnesium contents in excess of about 10 percent by weight of the aluminum alloy may be employed to moderate the temperature conditions required for infiltration. The magnesium content may be reduced when used in conjunction with an auxiliary alloying element, but these elements serve an auxiliary function only and are used together with at least the above-specified minimum amount of magnesium. For example, there was substantially no infiltration of nominally pure aluminum alloyed only with 10 percent silicon at 1000° C. into a bedding of 500 mesh, 39 Crystolon (99 percent pure silicon carbide from Norton Co.). However, in the presence of magnesium, silicon has been found to promote the infiltration process. As a further example, the amount of magnesium varies if it is supplied exclusively to the preform or filler material. It has been discovered that spontaneous infiltration will occur with a lesser weight percent of magnesium supplied to the system when at least some of the total amount of magnesium supplied is placed in the preform or filler material. It may be desirable for a lesser amount of magnesium to be provided in order to prevent the formation of undesirable intermetallics in the metal matrix composite body. In the case of a silicon carbide preform, it has been discovered that when the preform is contacted with an aluminum matrix metal, the preform containing at least about 1% by weight magnesium and being in the presence of a substantially pure nitrogen atmosphere, the matrix metal spontaneously infiltrates the preform. In the case of an alumina preform, the amount of magnesium required to achieve acceptable spontaneous infiltration is slightly higher. Specifically, it has been found that when an alumina preform, when contacted with a similar aluminum matrix metal, at about the same temperature as the aluminum that infiltrated into the silicon carbide preform, and in the presence of the same nitrogen atmosphere, at least about 3 percent by weight magnesium may be required to achieve similar spontaneous infiltration to that achieved in the silicon carbide preform discussed immediately above.

It is also noted that it is possible to supply to the spontaneous system infiltration enhancer precursor and/or infiltration enhancer on a surface of the alloy and/or on a surface of the preform or filler material and/or within the preform or filler material and/or in or on a surface of the powdered matrix metal prior to infiltrating the matrix metal into the filler material or preform (i.e., it may not be necessary for the supplied infiltration enhancer or Infiltration enhancer precursor to be alloyed with the matrix metal, but rather, simply supplied to the spontaneous system). If the magnesium was applied to a surface of the matrix metal it may be preferred that said surface should be the surface which is closest to, or preferably in contact with, the permeable mass of filler material or vice versa; or such magnesium could be mixed into at least a portion of the preform or filler material. Still further, it is possible that some combination of surface application, alloying and placement of magnesium into at least a portion of the preform could be used. Such combination of applying infiltration enhancer(s) and/or infiltration enhancer precursor(s) could result in a decrease in the total weight percent of magnesium needed to promote infiltration of the matrix aluminum metal into the preform, as well as achieving lower temperatures at which infiltration can occur. Moreover, the amount of undesirable intermetallics formed due to the presence of magnesium could also be minimized.

The use of one or more auxiliary alloying elements and the concentration of nitrogen in the surrounding gas also affects the extent of nitriding of the matrix metal at a given temperature. For example, auxiliary alloy elements such as zinc or iron included in the alloy, or placed on a surface of the alloy, may be used to reduce the infiltration temperature and thereby decrease the amount of nitride formation, whereas increasing the concentration of nitrogen in the gas may be used to promote nitride formation.

The concentration of magnesium in the alloy, and/or placed onto a surface of the alloy, and/or combined in the filler or preform material, also tends to affect the extent of infiltration at a given temperature. Consequently, in some cases where little or no magnesium is contacted directly with the preform or filler material, it may be preferred that at least about three weight percent magnesium be included in the alloy. Alloy contents of less than this amount, such as one weight percent magnesium, may require higher process temperatures or an auxiliary alloying element for infiltration. The temperature required to effect the spontaneous infiltration process of this invention may be lower: (1) when the magnesium content of the alloy alone is increased, e.g. to at least about 5 weight percent; and/or (2) when alloying constituents are mixed with the permeable mass of filler material or preform; and/or (3) when another element such as zinc or iron is present in the aluminum alloy. The temperature also may vary with different filler materials. In general, spontaneous and progressive infiltration will occur at a process temperature of at least about 675° C., and preferably a process temperature of at least about 750° C.–800° C. Temperatures generally in excess of 1200° C. do not appear to benefit the process, and a particularly useful temperature range has been found to be from about 675° C. to about 1200° C. However, as a general rule, the spontaneous infiltration temperature is a temperature which is above the melting point of the matrix metal but below the volatilization temperature of the matrix metal. Moreover, the spontaneous infiltration temperature should be below the melting point of the filler material. Still further, as temperature is increased, the tendency to form a reaction product between the matrix metal and infiltrating atmosphere increases (e.g., in the case of aluminum matrix metal and a nitrogen infiltrating atmosphere, aluminum nitride may be formed). Such reaction product may be desirable or undesirable based upon the intended application of the metal matrix composite body.

In the present method, for example, a permeable filler material or preform comes into contact with molten aluminum in the presence of, at least sometime during the process, a nitrogen-containing gas. The nitrogen-containing gas may be supplied by maintaining a continuous flow of gas into contact with at least one of the filler material or preform and/or molten aluminum matrix metal. Although the flow rate of the nitrogen-containing gas is not critical, it is preferred that the flow rate be sufficient to compensate for any nitrogen lost from the atmosphere due to nitride formation in the alloy matrix, and also to prevent or inhibit the incursion of air which can have an oxidizing effect on the molten metal. Additionally, electric resistance heating is typically used to achieve the infiltrating temperatures. However, any heating means which can cause the matrix metal to become molten and does not adversely affect spontaneous infiltration, is acceptable for use with the invention.

The method of forming a metal matrix composite is applicable to a wide variety of filler materials, and the choice of filler materials will depend on such factors as the matrix alloy, the process conditions, the reactivity of the molten matrix alloy with the filler material, and the properties sought for the final composite product. For example, when aluminum is the matrix metal, suitable filler materials include (a) oxides, e.g. alumina; (b) carbides, e.g. silicon carbide; (c) borides, e.g. aluminum dodecaboride, and (d) nitrides, e.g. aluminum nitride. If there is a tendency for the filler material to react with the molten aluminum matrix metal, this might be accommodated by minimizing the infiltration time and temperature or by providing a non-reactive coating on the filler. The filler material may comprise a substrate, such as carbon or other non-ceramic material, bearing a ceramic coating to protect the substrate from attack or degradation. Suitable ceramic coatings include oxides, carbides, borides and nitrides. Ceramics which are preferred for use in the present method include alumina and silicon carbide in the form of particles, platelets, whiskers and fibers. The fibers can be discontinuous (in chopped form) or in the form of continuous filament, such as multifilament tows. Further, the filler material or preform may be homogeneous or heterogeneous.

Certain filler materials exhibit enhanced infiltration relative to filler materials having a similar chemical composition. For example, crushed alumina bodies made by the method disclosed in U.S. Pat. No. 4,713,360, entitled "Novel Ceramic Materials and Methods of Making Same", which issued on Dec. 15, 1987, in the names of Marc S. Newkirk et al., exhibit desirable infiltration properties relative to commercially available alumina products. Moreover, crushed alumina bodies made by the method disclosed in Commonly Owned U.S. Pat. No. 4,851,375, entitled "Composite Ceramic Articles and Methods of Making Same", which issued Jul. 25, 1989, in the names of Marc S. Newkirk et al., also exhibit desirable infiltration properties relative to commercially available alumina products. The subject matter of each of the issued Patents is herein expressly incorporated by reference. Thus, it has been discovered that complete infiltration of a permeable mass of ceramic material tan occur at lower infiltration temperatures and/or lower infiltration times by utilizing a crushed or comminuted body produced by the method of the aforementioned U.S. Patents.

The size and shape of the filler material can be any that may be required to achieve the properties desired in the composite. Thus, the material may be in the form of particles, whiskers, platelets or fibers since infiltration is not restricted by the shape of the filler material. Other shapes such as spheres, tubules, pellets, refractory fiber cloth, and the like may be employed. In addition, the size of the material does not limit infiltration, although a higher temperature or longer time period may be needed for complete infiltration of a mass of smaller particles than for larger particles. Further, the mass of filler material (shaped into a preform) to be infiltrated must be permeable to molten matrix metal and to the infiltrating atmosphere.

The method of forming metal matrix composites according to the present invention, not being dependent on the use of pressure to force or squeeze molten matrix metal into a preform or a mass of filler material, permits the production of substantially uniform metal matrix composites having a high volume fraction of filler material and low porosity. Higher volume fractions of filler material may be achieved by using a lower porosity initial mass of filler material. Higher volume fractions also may be achieved if the mass of filler is compacted or otherwise-densified provided that the mass is not converted into either a compact with close cell porosity or into a fully dense structure that would prevent infiltration by the molten alloy. With the present invention, low volume fractions of filler material may also be made, thus providing an overall range of 1 to 75 percent, or higher, of obtainable volume fractions.

It has been observed that for aluminum infiltration and matrix formation around a ceramic filler, wetting of the ceramic filler by the aluminum matrix metal may be an important part of the infiltration mechanism. Moreover, at low processing temperatures, a negligible or minimal amount of metal nitriding occurs resulting in a minimal discontinuous phase of aluminum nitride dispersed in the metal matrix. However, as the upper end of the temperature range is approached, nitridation of the metal is more likely to occur. Thus, the amount of the nitride phase in the metal matrix can be controlled by varying the processing temperature at which infiltration occurs. The specific process temperature at which nitride formation becomes more pronounced also varies with such factors as the matrix aluminum alloy used and its quantity relative to the volume of filler or preform, the filler material to be infiltrated, the powdered matrix metal used and its quantity relative to the volume of filler or preform, and the nitrogen concentration of the infiltrating atmosphere. For example, the extent of aluminum nitride formation at a given process temperature is believed to increase as the ability of the alloy to wet the filler decreases and as the nitrogen concentration of the atmosphere increases.

It is therefore possible to tailor the constituency of the metal matrix during formation of the composite to impart certain characteristics to the resulting product. For a given system, the process conditions can be selected to control the nitride formation. A composite product containing an aluminum nitride phase will exhibit certain properties which can be favorable to, or improve the performance of, the product. Further, the temperature range for spontaneous infiltration with an aluminum alloy may vary with the ceramic material used. In the case of alumina as the filler material, the temperature for infiltration should preferably not exceed about 1000° C. if it is desired that the ductility of the matrix not be reduced by the significant formation of nitride. However, temperatures exceeding 1000° C. may be employed if it is desired to produce a composite with a less ductile and stiffer matrix. To infiltrate silicon carbide, higher temperatures of about 1200° C. may be employed since the aluminum alloy nitrides to a lesser extent, relative to the use of alumina as filler, when silicon carbide is employed as a filler material.

Moreover, it is possible to use a reservoir of matrix metal to assure complete infiltration of the filler material and/or to supply a second metal which has a different composition from the first source of matrix metal. Specifically, in some cases it may be desirable to utilize a matrix metal in the reservoir which differs in composition from the first source of matrix metal. For example, if an aluminum alloy is used as the first source of matrix metal, then virtually any other metal or metal alloy which was molten at the processing temperature could be used as the reservoir metal. Molten metals frequently are very miscible with each other which would result in the reservoir metal mixing with the first source of matrix metal so long as an adequate amount of time is given for the mixing to occur. Thus, by using a reservoir metal which is different in composition than the first source of matrix metal, it is possible to tailor the properties of the metal matrix to meet various operating requirements and thus tailor the properties of the metal matrix composite.

A barrier means may also be utilized in combination with the present invention. Specifically, the barrier means for use with this invention may be any suitable means which interferes, inhibits, prevents or terminates the migration, movement, or the like, of molten matrix alloy (e.g., an aluminum alloy) beyond the defined surface boundary of the filler material. Suitable barrier means may be any material, compound, element, composition, or the like, which, under the process conditions of this invention, maintains some integrity, is not volatile and preferably is permeable to the gas used with the process as well as being capable of locally inhibiting, stopping, interfering with, preventing, or the like, continued infiltration or any other kind of movement beyond the defined surface boundary of the ceramic filler. Suitable barrier means includes materials which are substantially non-wettable by the migrating molten matrix alloy under the process conditions employed. A barrier of this type appears to exhibit little or no affinity for the molten matrix alloy, and movement beyond the defined surface boundary of the filler material or preform is prevented or inhibited by the barrier means. The barrier reduces any final machining or grinding that may be required of the metal matrix composite product. As stated above, the barrier preferably should be permeable or porous, or rendered permeable by puncturing, to permit the gas to contact the molten matrix alloy.

Suitable barriers particularly useful for aluminum matrix alloys are those containing carbon, especially the crystalline allotropic form of carbon known as graphite. Graphite is essentially non-wettable by the molten aluminum alloy under the described process conditions. A particular preferred graphite is a graphite tape product that is sold under the trademark Grafoil®, registered to Union Carbide. This graphite tape exhibits sealing characteristics that prevent the migration of molten aluminum alloy beyond the defined surface boundary of the filler material. This graphite tape is also resistant to heat and is chemically inert. Grafoil® graphite material is flexible, compatible, conformable and resilient. It can be made into a variety of shapes to fit any barrier application. However, graphite barrier means may be employed as a slurry or paste or even as a paint film around and on the boundary of the filler material or preform. Grafoil® is particularly preferred because it is in the form of a flexible graphite sheet. In use, this paper-like graphite is simply formed around the filler material or preform.

Other preferred barrier(s) for aluminum metal matrix alloys in nitrogen are the transition metal borides (e.g., titanium diboride ($TiB_2$)) which are generally non-wettable by the molten aluminum metal alloy under certain of the process conditions employed using this material. With a barrier of this type, the process temperature should not exceed about 875° C., for otherwise the barrier material becomes less efficacious and, in fact, with increased temperature infiltration into the barrier will occur. The transition metal borides are typically in a particulate form (1–30 microns). The barrier materials may be applied as a slurry or paste to the boundaries of the permeable mass of ceramic filler material which preferably is preshaped as a preform.

Other useful barriers for aluminum metal matrix alloys in nitrogen include low-volatile organic compounds applied as a film or layer onto the external surface of the filler material or preform. Upon firing in nitrogen, especially at the process conditions of this invention, the organic compound decomposes leaving a carbon soot film. The organic compound may be applied by conventional means such as painting, spraying, dipping, etc. Moreover, finely ground particulate materials can function as a barrier so long as infiltration of the particulate material would occur at a rate which is slower than the rate of infiltration of the filler material.

Thus, the barrier means may be applied by any suitable means, such as by covering the defined surface boundary with a layer of the barrier means. Such a layer of barrier means may be applied by painting, dipping, silk screening, evaporating, or otherwise applying the barrier means in liquid, slurry, or paste form, or by sputtering a vaporizable barrier means, or by simply depositing a layer of a solid particulate barrier means, or by applying a solid thin sheet or film of barrier means onto the defined surface boundary. With the barrier means in place, spontaneous infiltration substantially terminates when the infiltrating matrix metal reaches the defined surface boundary and contacts the barrier means.

Various demonstrations of the present invention are included in the Examples immediately following. However, these Examples should be considered as being illustrative and should not be construed as limiting the scope of the invention as defined in the appended claims.

EXAMPLES 1–4

These examples illustrate the formation of metal matrix composites having variable and tailorable ceramic particle loading through the admixing of varying amounts of powdered matrix metal with a filler material formed into a preform. In each of the following examples (as summarized in Table 1) spontaneous infiltration was achieved and the bodies produced through the addition of powdered matrix metal (Examples 2–4) exhibited similar structure and appearance to the body spontaneously infiltrated into the filler material without the powdered matrix metal (Example 1), except for the differences in the particle loadings.

FIG. 1 is a schematic of the lay-up (10) which was used for Examples 1–4.

A preform (1) was first made for each of Examples 1–4. In Example 1, the preform was comprised of 100 percent 220 grit alumina (220 grit 38 Alundum by Norton Company). In Examples 2–4, the preform was comprised of a mixture of the same 220 grit alumina and a powdered aluminum alloy having a composition by weight of about 10 percent silicon, 3 percent magnesium and the remainder aluminum (Al-10 Si-3 Mg), which was powdered via conventional powdering techniques to –200 mesh. The relative weight percent of alumina and aluminum alloy was varied in Examples 2–4, as summarized in Table 1.

The alumina and aluminum alloy in Examples 2–4 were dry mixed and then pressed into 1 inch by 2 inch rectangles having thicknesses of about 0.5 inch in a hardened steel die at about 10 psi without the addition of any binder. The aluminum alloy was sufficiently soft to bind the filler to the preformed shape. A similar rectangle of alumina was pressed to form the preform of Example 1.

The preformed rectangles of Examples 1–4 were then placed in a bedding (2) of 500 grit alumina (500 grit 38 Alundum by Norton Company), which nominally acted as a barrier during infiltration. The bedding was contained in a refractory boat (3) (Bolt Technical Ceramics, BTC-Al-99.7%, "Alumina Sagger", 10 mm L, 45 mm W, 19 mm H). For purposes of the experiment, there was no need to provide a more effective barrier. Net shape or near net shape, however, could be achieved with more effective barrier means of the type described above (e.g., Grafoil® tape).

An ingot (4) of aluminum alloy (Al-10 Si-3 Mg) of similar size to the preform rectangle (1) was placed on top of each of preform discs (1).

The lay-up (10) was then placed in a sealed 3 inch electric resistance tube furnace. Forming gas (96 volume percent nitrogen–4 volume percent hydrogen) was then flowed through the furnace at a flow rate of about 250 cc/min. The furnace temperature was ramped up at about 150° C. per hour to a temperature of about 825° C., and held at about 825° C. for about 5 hours. The furnace temperature was then ramped down at about 200° C. per hour, and the samples were removed, section mounted and polished. Photomicrographs of the samples of Examples 1–4 are set forth as FIGS. 2–5. Image analysis was also performed to determine the area percent of ceramic particles to matrix metal for each of the Examples, as summarized in Table 1. As noted in Table 1 and Illustrated by FIGS. 2–5 spontaneous Infiltration was achieved in each of the samples and the particle loading was found to decrease in relation to the amount of powdered matrix metal in the preform.

EXAMPLE 5

This Example illustrates the formation of a metal matrix composite having a tailorable ceramic particle loading and tailorable metallic constituent through the admixing of various powdered metals into the filler material.

A filler material mixture comprising a blend of ceramic filler and metallic particulates and weighing about 90 grams was prepared by mixing together about 20.1 grams of particulate metallic constituent and the balance –325 mesh, T-64 Tabular Alumina tabular alumina (Alcoa Industrial Chemicals Div., Bauxite, Ariz.). The metallic constituents of the filler material mixture comprised –325 mesh particulates of the following elements: about 10.2 grams of zinc (Fisher Scientific, Pittsburgh, Pa.), about 4.5 grams of magnesium (Reade Mfg. Co., Lakehurst, N.J.), about 3.0 grams of copper (Alcan International, Ltd., Cambridge, Mass.), about 0.75 grams of iron (Atlantic Equipment Engineers, Bergenfield, N.J.), about 0.60 grams of silicon (Alfa Products, Morton-Thiokol, Inc., Danvers, Mass., about 0.45 grams of manganese (Alfa Products), about 0.30 grams of chromium (Atlantic Equiment Engineers), and about 0.30 grams of titanium (Consolidated Astronautics, Div. of United-Guardian, Inc., Hauppauge, N.Y.).

The filler material mixture was roll mixed in a one liter plastic Jar containing about 50 grams of about ¼ inch (6 mm) diameter BURUNDUM® alumina milling media (U.S. Stoneware Corp., Mahwah, N.J.). After roll mixing for about 2 hours, the filler material was poured into a GRAFOIL® graphite foil box (Union Carbide Company, Danbury, Conn.) measuring about 3 inches (76 mm) by about 1½ inches (38 mm) by about 1½ inches (38 mm) high and leveled. About 0.3 grams of –100 mesh magnesium particulate material (Hart Corporation, Tamaqua, Pa.) was sprinkled evenly over the top of the loose filler material. The graphite foil box and its contents were then placed into a graphite boat having outer dimensions of about 5 inches (127 mm) by about 9 inches (229 mm) by about 3 inches (76 mm) high, and having a uniform wall thickness of about ½ inch (13 mm). A particulate material of 180 grit 39 CRYSTOLON® Green silicon carbide (Norton Company, Worcester, Mass.) was poured into the graphite boat around the graphite foil box to a level of about ½ inch (13 mm) below the top of the graphite foil box, and slightly higher out towards the walls of the graphite boat. An ingot of matrix metal weighing about 131 grams and measuring about 2 inches (51 mm) by about 1 inch (25 mm) by about ⅝ inch (16 mm) and comprising commercially pure aluminum was placed into the graphite foil box and centered on top of the layer of magnesium particles.

The graphite boat and its contents were placed into a resistance heated controlled atmosphere furnace at a temperature of about 98° C. The furnace chamber was evacuated to about 30 inches (762 mm) of mercury vacuum and held under vacuum for about 15 minutes. The chamber was then backfilled with nitrogen gas to approximately atmospheric pressure. A nitrogen gas flow rate of about 5 liters per minute was established within the furnace. The furnace temperature was then increased to about 700° C. at a rate of about 200° C. per hour. After maintaining a temperature of about 700° C. for about 15 hours, the furnace temperature was then decreased to about 690° C. at a rate of about 200° per hour. At a temperature of about 690° C., the graphite boat and its contents were removed from the furnace and placed onto a water cooled aluminum quench plate. A FEEDOL® 9 particulate hot topping material (Foseco, Inc., Cleveland, Ohio) was poured onto the top of the residual molten matrix metal. An approximately 2 inch (51 mm) thick layer of CERABLANKET® ceramic fiber insulation (Manville Refractory Products, Denver, Colo.) was placed over the entire graphite boat. After cooling to substantially room temperature, the graphite foil box was removed from the graphite boat. The graphite foil box was then disassembled to reveal that a portion of the matrix metal had infiltrated the filler material to produce a metal matrix composite material.

Quantitative image analysis on a polished cross-section of the formed metal matrix composite material revealed that the volumetric loading of the tabular alumina reinforcement was about 25 volume percent.

EXAMPLE 6

This Example demonstrates that the filler reinforcement loading in a metal matrix composite can be reduced, while simultaneously modifying the composition of the matrix metal of the composite by adding a powdered metal or metal alloy having a composition different from the matrix metal to the filler material or preform.

A graphite foil box measuring about 3¼ inches long by about 1¾ inches wide by about 4½ inches high was fabricated from a single sheet of GRAFOIL® graphite foil (Union Carbide Company, Danbury, Conn.), measuring about 0.015 inch thick, by making strategically placed cuts and folds in the sheet. The folded portions of the GRAFOIL® box were cemented together with RIGIDLOCK® graphite cement (Polycarbon Corporation, Valencia, Calif.), and the cemented portions were further reinforced by stapling the box. The formed GRAFOIL® box was then placed into a graphite boat having a wall thickness of about ½ inch, and measuring about 9 inches by about 5 inches by about 4 inches high.

About 200 grams of a filler material admixture comprising by weight about 20 percent copper particulate, about 1.6% −325 mesh magnesium particulate (Reade Manufacturing Company, Lakehurst, N.J.) and the balance Grade T-64 −325 mesh tabular alumina (Alcoa Industrial Chemicals Division, Bauxite, Ariz.) were placed into a dry approximately 1.1 liter porcelain ball mill (U.S. Stoneware Corporation, Mahwah, N.J.) containing about 400 grams of approximately ½ inch diameter BURUNDUM® ball milling media (U.S. Stoneware, Mahwah, N.J.). The ball mill lid was secured, and the filler material admixture was ball milled for about 2 hours. After ball milling, about 99 grams of the filler material admixture were poured into the GRAFOIL® box and leveled. About ½ gram of −100 mesh magnesium particulate (Hart Corporation, Tamaqua, Pa.) was sprinkled evenly over the surface of the filler material admixture. An approximately 446 gram ingot of matrix metal measuring about 1⅝ inches square and about 4 inches high and comprising commercially pure aluminum (Aluminum Association 170.1), was sandblasted to remove any surface oxide. The ingot was then cleaned with ethyl alcohol to remove any debris from the sandblasting operation and placed onto the layer of magnesium particulate within the GRAFOIL® box.

The graphite boat and its contents were placed into a retort within a controlled atmosphere furnace at substantially room temperature. The furnace was sealed, evacuated to a vacuum about 30 inches of mercury and then backfilled with nitrogen gas to establish a nitrogen gas flow rate of about 5 liters per minute. The temperature in the furnace was then increased to about 800° C. at a rate of about 200° C. per hour, maintained at about 800° C. for about 15 hours, then decreased to about 760° C. at a rate of about 200° C. per hour. At a temperature of about 760° C., the graphite boat and its contents were removed from the retort and placed onto a water cooled aluminum quench plate. FEEDOL® No. 9 hot topping particulate mixture was then poured over the residual molten matrix metal reservoir. After the exothermic reaction from the hot topping mix had substantially subsided, the top and sides of the graphite boat were covered with an approximately 2 inch thick layer of CERABLANKET® ceramic fiber blanket material (Manville Refractory Products, Denver, Colo.). At about room temperature, the lay-up was removed from the graphite boat and the GRAFOIL® box was disassembled to reveal that matrix metal had infiltrated the filler material admixture to form a metal matrix composite body.

Quantitative image analysis of the formed metal matrix composite body was carried out using a Nikon microphoto-FX optical microscope with a DAGE-MTI series 68 video camera (DAGE-MTI Inc., Michigan City, Ind.) attached to the top port. The video camera signal was sent to a Model DV-4400 scientific optical analysis system (Lamont Scientific State College, Pa.). Results of the quantative image analysis revealed that the volumetric loading of the tabular alumina constituent of the filler material was approximately 47 volume percent.

Semi-quantitative analysis was performed on the matrix metal phase of the metal matrix composite body to determine the constituents present within the matrix metal. Analysis was carried out using the energy dispersive X-ray analysis (EDAX) feature (Model VZ15, Princeton Gama Tech, Inc., Princeton, N.J.) on a scanning electron microscope (Model 500, Philips N. V., Eindhoven, The Netherlands) coupled to a spectrum analyzer (Tracor Northern Inc., Middleton, Wis). The elemental composition analysis of six discrete spots in the matrix metal indicated that copper was present in the matrix metal of the formed metal matrix composite body.

TABLE 1

| Example No. | Corre-sponding Figure | 220 Grit Alumina Filler Material (wt %) | Al-10Si-3Mg Powdered Matrix Metal (wt %) | Ramp Up (°C./hr) | Dwell (°C./hrs) | Ramp Down (°C./hr) | Atmosphere (H2/N2) | Infiltra-tion | Area Fraction Particles |
|---|---|---|---|---|---|---|---|---|---|
| 1 | 2 | 100 | 0 | 150 | 825/5 | 200 | 250 cc/min | Yes | 54% |
| 2 | 3 | 75 | 25 | 150 | 825/5 | 200 | 250 cc/min | Yes | 21% |
| 3 | 4 | 50 | 50 | 150 | 825/5 | 200 | 250 cc/min | Yes | 11% |
| 4 | 5 | 25 | 75 | 150 | 825/5 | 200 | 250 cc/min | Yes | 6% |

What is claimed:

1. A method for forming a metal matrix composite body comprising:

mixing at least two powdered matrix metals with at least one substantially non-reactive filler material to form a permeable mass;

contacting said permeable mass with a molten source of matrix metal alloy, wherein said molten source of matrix metal alloy and one of said at least two powdered matrix metals are comprised of substantially the same metal;

spontaneously infiltrating at least a portion of the permeable mass with molten matrix metal; and cooling said matrix metal within said permeable mass, thereby forming a metal matrix composite body.

2. The method of claim 1, wherein a ration of powdered matrix metal to filler is varied within the permeable mass, thereby resulting in a metal matrix composite having a variable particle loading.

3. The method of claim 1, wherein said permeable mass comprises a preform.

4. The method of claim 1, wherein at least one of said at least two powdered matrix metals comprise copper and said molten source of matrix metal comprises aluminum.

5. The method of claim 1, wherein at least one of said at least two powdered matrix metals comprises at least one metal selected from the group consisting of zinc, copper, iron, silicon, manganese, chromium, and titanium.

6. The method of claim 1, wherein the permeable mass comprises from about 1 to 75 volume percent powdered matrix metal.

7. A method for forming a metal matrix composite body comprising:

mixing at least two powdered matrix metals with at least one substantially non-reactive filler material to form a permeable mass;

providing an infiltrating atmosphere;

contacting said permeable mass with a source of molten matrix metal alloy, wherein said molten source of matrix metal alloy and one of said at least two powdered matrix metals are comprised of substantially the same metal;

providing at least one of an infiltration enhancer and an infiltration enhancer precursor to at least one of said matrix metal alloy, said permeable mass and said infiltrating atmosphere to cause spontaneous infiltration of the matrix metal into the permeable mass to occur;

spontaneously infiltrating at least a portion of the permeable mass with molten matrix metal; and cooling said matrix metal within said permeable mass thereby forming a metal matrix composite body.

8. The method of claim 7, wherein said permeable mass comprises a preform.

9. The method of claim 7, wherein at least one of said at least two powdered matrix metals comprises copper and said molten source of matrix metal comprises aluminum.

10. The method of claim 7, wherein at least one of said at least two powdered matrix metals comprises at least one metal selected from the group consisting of zinc, copper, iron, silicon, manganese, chromium, and titanium.

11. The method of claim 7, wherein a ratio of powdered matrix metal to filler is varied within the permeable mass, thereby resulting in a metal matrix composite having a variable particle loading.

12. The method of claim 7, wherein the permeable mass comprises from about 1 to 75 volume percent powdered matrix metal.

13. A method for forming a metal matrix composite comprising:

mixing at least two powdered matrix metals with at least one substantially non-reactive filler material to form a permeable mass, wherein a ratio of powdered matrix metal to filler is varied within the permeable mass; and spontaneously infiltrating the permeable mass with a source of molten matrix metal, wherein said molten source of matrix metal and one of said at least two powdered matrix metals are comprised of substantially the same metal, thereby forming a metal matrix composite having a variable filler loading.

14. The method of claim 13, wherein said permeable mass comprises a preform.

15. The method of claim 13, wherein at least one of said at least two powdered matrix metals comprises copper and said molten source of matrix metal comprises aluminum.

16. The method of claim 13, wherein at least one of said at least two powdered matrix metals comprises at least one metal selected from the group consisting of zinc, copper, iron, silicon, manganese, chromium, and titanium.

17. The method of claim 13, wherein the permeable mass comprises from about 1 to 75 volume percent powdered matrix metal.

18. The method of claim 13, wherein at least one of an infiltration enhancer and an infiltration enhancer precursor is provided to at least one of said matrix metal alloy and said permeable mass for at least a portion of said spontaneous infiltration.

19. The method of claim 18, additionally comprising contacting said permeable mass with an infiltrating atmosphere for at least a portion of said spontaneous infiltration.

* * * * *